United States Patent [19]

Delattre

[11] Patent Number: 4,979,495

[45] Date of Patent: Dec. 25, 1990

[54] VERTICALLY DISPLACEABLE FIREPLACE SYSTEM

[76] Inventor: Joseph Delattre, 2300 Harwood Boul., Vaudreuil, Quebec, Canada, J7V 5V5

[21] Appl. No.: 475,408

[22] Filed: Feb. 2, 1990

[51] Int. Cl.[5] ..... F24B 1/18

[52] U.S. Cl. ..... 126/500; 126/509; 126/554; 126/242; 52/30; 52/122.1

[58] Field of Search ..... 126/500, 503, 506, 509, 126/531, 529, 546, 547, 554, 555, 242; 52/29, 30, 123.1, 218, 219, 122.1

[56] References Cited

U.S. PATENT DOCUMENTS

| | | | |
|---|---|---|---|
| 2,550 | 4/1842 | Mitchell | 126/509 |
| 103,134 | 5/1870 | Brase et al. | 126/511 |
| 940,570 | 11/1909 | Wilson | 126/546 |
| 2,484,239 | 10/1949 | Moon et al. | 126/243 |
| 3,034,464 | 5/1962 | Bryan | 126/506 |
| 4,062,344 | 12/1977 | Mayes | 126/509 |
| 4,074,680 | 2/1978 | Gooding | 126/550 |
| 4,263,888 | 4/1981 | Pitts | 126/506 |
| 4,381,760 | 5/1983 | Reges | 126/531 |

*Primary Examiner*—James C. Yeung
*Attorney, Agent, or Firm*—Darby & Darby

[57] ABSTRACT

There is disclosed a fireplace system to be installed in a chimney, the chimney having at least two openings in side walls of the chimney, comprising a hearth vertically moveable in the chimney, the hearth being accessible through the openings, doors to seal the openings, lifting means connected to the hearth for moving the hearth vertically in the chimney, vertical guide means for guiding the hearth in the chimney during vertical motion, and holding means for holding the hearth at a vertical position.

11 Claims, 3 Drawing Sheets

VERTICALLY DISPLACEABLE FIREPLACE SYSTEM

BACKGROUND OF THE INVENTION

The present invention relates to a fireplace system having a hearth which is vertically displaceable within a chimney.

The present invention solves a number of problems associated with fireplaces. Fireplaces, i.e. the hearth and its surroundings which support the burning wood or fuel, are difficult and messy to clean. According to the invention, the fireplace can be moved to a place where cleaning can be easier. Building a fire can also be messy and tricky. The vertically displaceable hearth can be moved to a place where a fire can be started, then the fire and the hearth containing the fire are moved to a place where they can be enjoyed.

Moving wood, in the case of a wood fireplace, from where it is stored to where it is to be burned is also messy and troublesome. In a preferred embodiment of the invention, a storage compartment, which can be used to store a load of firewood, is provided connected below the moveable hearth, so that wood or fuel can be moved from a storage place to a place where the fire is to be enjoyed with ease. Additionally, it is preferred to use the fireplace to heat a building. According to preferred embodiment of the invention, the hearth is vertically displaceable inside a first metal chimney duct over which air to be heated can be circulated. An outer chimney duct can be placed over the first so that an air circulation system connected to the outer duct can draw heat from the hearth to heat a building.

SUMMARY OF THE INVENTION

The present invention provides a fireplace system to be installed in a chimney, the chimney having at least two openings in side walls of the chimney, the system comprising a hearth vertically moveable in the chimney, the hearth being accessible through the openings, doors to seal the openings, lifting means connected to the hearth for moving the hearth vertically in the chimney, vertical guide means for guiding the hearth in the chimney during vertical motion, and holding means for holding the hearth at a vertical position.

Preferably, the fireplace system also comprises a storage shelf provided below the hearth, and means connecting the shelf to the hearth, the shelf being solid with the hearth, the shelf being accessible through at least one the openings so that the shelf can be used for storing wood or other objects.

Preferably, the fireplace system also comprises an ash drawer supported by an ash drawer mounting, the mounting being connected to a lower surface of the hearth, the drawer being slideable in the mounting, the drawer in use to receive ashes from the hearth, the hearth being provided with a grating located over the drawer and through which the ashes may pass from the hearth to the drawer.

Preferably, the lifting means comprise a hydraulic power jack, having one extremity connectected to a lower part of said hearth.

The invention further provides a fireplace system to be installed in a chimney, the chimney having at least two openings in side walls of the chimney, the chimney comprising an inner metal duct and an outer duct, the outer duct surrounding the inner metal duct except at the openings, the system comprising a hearth vertically moveable in the inner metal duct, the hearth being accessible through the openings, at least one door to seal one or more the openings, which are located above a lowest one of the openings, lifting means connected to the hearth for moving the hearth vertically in the chimney, vertical guide means for guiding the hearth in the inner metal duct during vertical motion, holding means for holding the hearth at a vertical position, and air circulation means to circulate air from between the inner duct and the outer duct with air of an area to be heated.

The invention also provides a fireplace system to be installed in a chimney, the chimney having upper and lower openings in side walls of the chimney at a plurality of floor levels, the system comprising a hearth vertically moveable in the chimney, the hearth being accessible through the upper openings, storage shelf provided below the hearth, and means connecting the shelf to the hearth, the shelf being free to move vertically with the hearth, and the shelf to be used for storing wood or other objects, the shelf being accessible through the lower openings, at least two doors to seal the openings which are located above a lowest floor level, lifting means connected to the hearth for moving the hearth vertically in the chimney, vertical guide means for guiding the hearth in the chimney during vertical motion, and holding means for holding the hearth at a vertical position.

BRIEF DESCRIPTION OF THE DRAWINGS

Other objects and advantages of the invention will become clear by the following description of a preferred embodiment with reference to the appended drawings in which.

DETAILED DESCRIPTION OF THE PREFERRED EMBODIMENT

Figure 1:
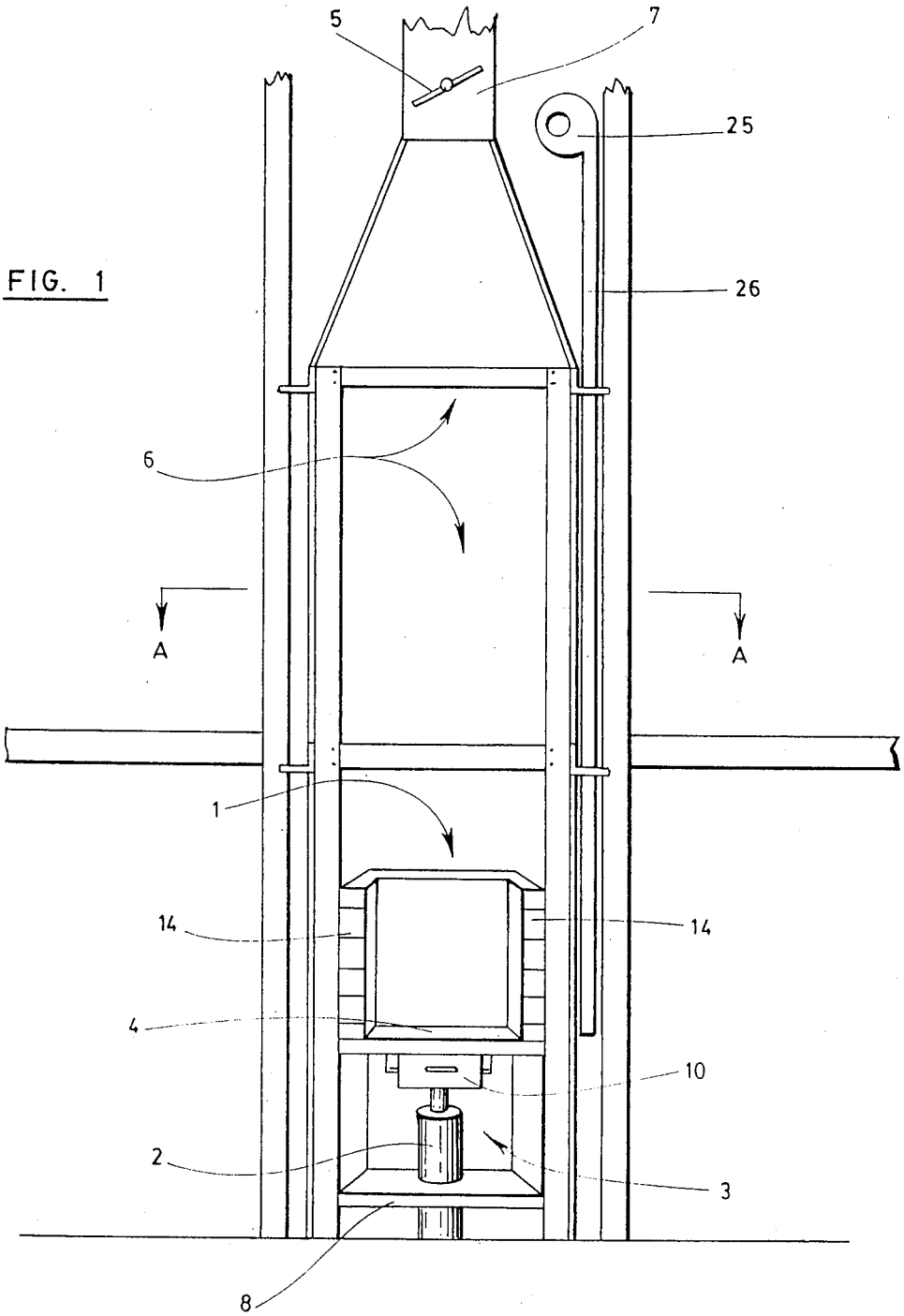
FIG. 1 is a front cut-away view of a preferred embodiment of the present invention.
Figure 3:
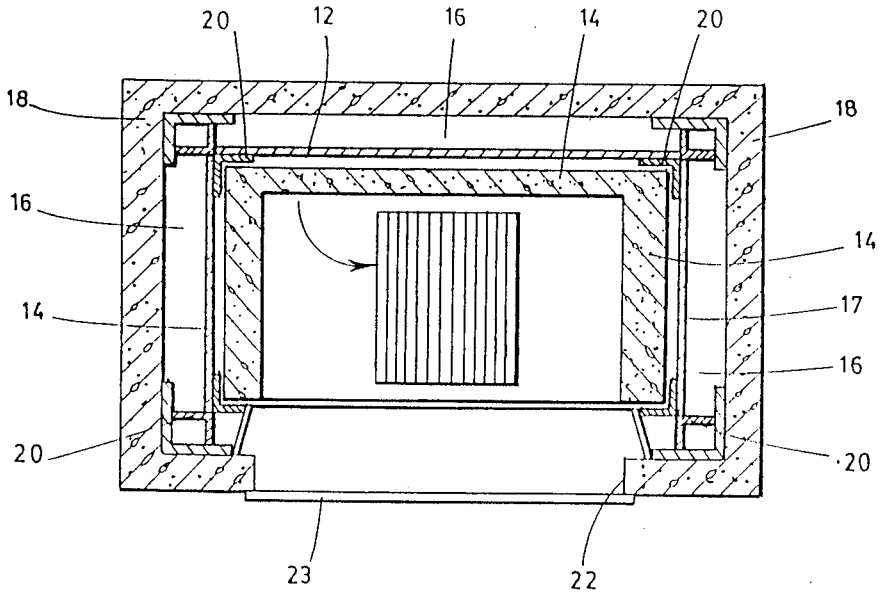
FIG. 3 is a cross-sectional plan view along the line A—A of FIG. 1.

As shown in FIG. 1, hearth 1 includes bottom 4 and walls 14. Walls 14 are provided on the sides and rear of the hearth 1. A drawer 10, slideable in an "L"-shaped bracket mounting, is provided to receive ashes from the bottom 4 of hearth 1 through grating 12 as shown in FIG. 3. A storage compartment 3 is provided below hearth 1.

Compartment 3 can be used to place a quantity of wood or fuel in it at a place where the wood or fuel is kept. In FIG. 1, the hearth is movable between a basement and a first floor of a house inside a chimney 6 by means of hydraulic cylinder 2, which is attached to both hearth 1 and a base 8 of compartment 3.

As shown in FIG. 3, the hearth 1 is able to move vertically in chimney duct 17 and be guided by four guide rails 20. The four guide rails 20 are fixed to outer chimney duct 18. An air space 16 is provided between duct 17 and outer duct 18 made of brick. Duct 17 extends through duct 18 at openings 22.

Figure 2:
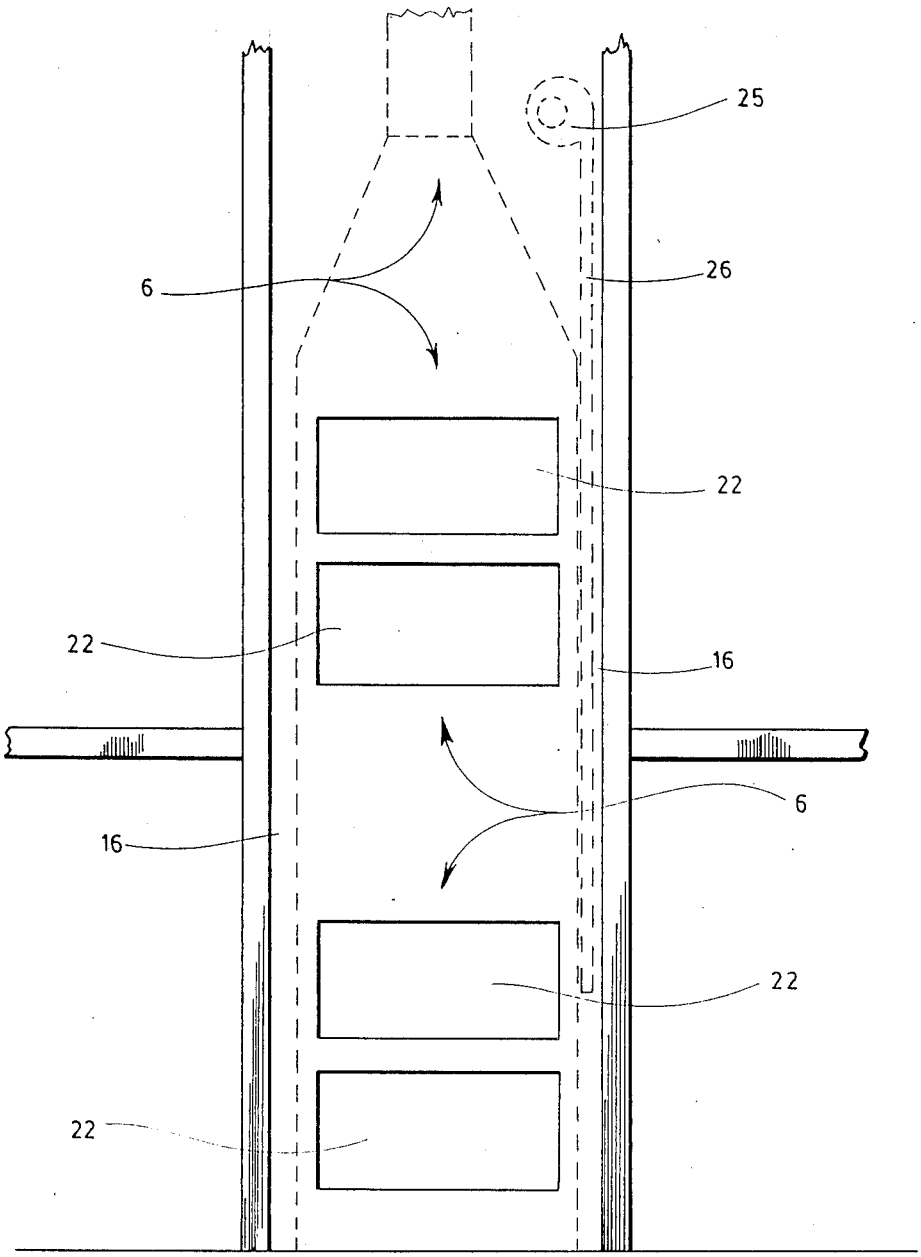
FIG. 2 is a front view of a chimney with openings containing the embodiment of FIG. 1.

FIG. 2 shows four openings 22, a first two of which are located on a first floor and a second two of which are located at a basement floor level. The two upper openings 22 of each level allow access to hearth 1, while the two lower openings 22 of each level allow access to compartment 3 and ash drawer 10. Compartment 3 has a shelf to be loaded with wood at the lower level, then at the first floor level a fire in hearth 1 may be stoked by moving wood from compartment 3 to hearth 1 as needed. Doors 23 are provided at the second two openings 22 to seal any downdraft. A flue 5 is provided in chinmey pipe 7 to close the chimney pipe 7 when not in use. Of course, a manual remote control can be used to operate flue 5 from either floor level.

As can be seen, certain advantages are obtained in the positioning of the hearth 1 for cleaning at the basement level since the hearth 1 is elevated above floor level so that sweeping and cleaning of the fireplace may be achieved without stooping. Similarly, compartment 3 is located near the floor level so that heavy logs need not be lifted very high. Of course, at the first floor the hearth 1 may be located at a lower opening 22 leaving compartment 3 temporarily unaccessible or at an upper opening 22 making compartment 3 accessible.

Although it has not been described herein, it is to be understood that the fireplace system is to be provided with means to control the elevating means, as are well known in the art.

In the preferred embodiment, air to be heated by the fireplace system is circulated in air space 16, the circulated air being exchanged with air of a space to be heated. A fan 25 draws in air from above duct 17 and forces it down a duct 26 to a lower level to be used, for example, by an existing home air circulation system (not shown).

Although the invention has been described above in detail in the framework of the preferred embodiment, it is to be understood that the scope of the present invention is to be determined by the appended claims.

I claim:

1. A fireplace system to be installed in a chimney, the chimney having at least two openings in side walls of the chimney, comprising:

a hearth vertically moveable in said chimney, said hearth being accessible through said openings;

doors to seal said at least two openings;

a storage shelf provided below said hearth, and means connecting said shelf to said hearth, said shelf being solid with said hearth, said shelf being accessible through at least one of said openings so that said shelf may be used for storing wood or other objects;

lifting means connected to said hearth for moving said hearth vertically in said chimney;

vertical guide means for guiding said hearth in said chimney during vertical motion; and holding means for holding said hearth at a vertical position.

2. A fireplace system as claimed in claim 1, wherein said lifting means are connected to said shelf.

3. A fireplace system as claimed in claim 2, wherein said lifting means comprise a hydraulic power jack, having one extremity connectected to a lower part of said hearth.

4. A fireplace system as claimed in claim 1, further comprising an ash drawer supported by an ash drawer mounting, said mounting being connected to a lower surface of said hearth, said drawer being slideable in said mounting, said drawer in use to receive ashes from said hearth, said hearth being provided with a grating located over said drawer and through which said ashes may pass from said hearth to said drawer.

5. A fireplace system as claimed in claim 4, wherein said mounting comprises two substantially "L" shaped brackets facing each other at each lateral side of said drawer, and said drawer is provided with projecting elongated members capable of sliding in said brackets.

6. A fireplace system as claimed in claim 1, wherein said lifting means comprise a hydraulic power jack, having one extremity connectected to a lower part of said hearth.

7. A fireplace system as claimed in claim 1, further comprising lift control means provided to control said lift means and said holding means.

8. A fireplace system as claimed in claim 7, wherein said lift control means include input devices at each of said openings, such that activating one of said input devices will call said hearth and said shelf to one of said openings where said input device is activated.

9. A fireplace system to be installed in a chimney, the chimney having at least two openings in side walls of the chimney, the chimney comprising an inner metal duct and an outer duct, said outer duct surrounding said inner metal duct except at said openings, said system comprising:

a hearth vertically moveable in aid inner metal duct, said hearth being accessible through said openings;

doors to seal said at least two openings;

a storage shelf provided below said hearth, and means connecting said shelf to said hearth, aid shelf being solid with said hearth, said shelf being accessible through at least one of said openings so that said shelf may be used for storing wood or other objects;

lifting means connected to said hearth for moving said hearth vertically in said chimney;

vertical guide means for guiding said hearth in said inner metal duct during vertical motion;

holding means for holding said hearth at a vertical position; and air circulation means to circulate air from between said inner duct and said outer duct with air of an area to be heated.

10. A fireplace system as claimed in claim 9, wherein said doors are insulated and fire resistant so that heat from said inner metal duct is insulated from an exterior of said doors.

11. A fireplace system to be installed in a chimney, the chimney having upper and lower openings in side walls of the chimney at a plurality of floor levels, the system comprising:

a hearth vertically moveable in said chimney, said hearth being accessible through said upper openings;

a storage shelf provided below said hearth, and means connecting said shelf to said hearth, said shelf being free to move vertically with said hearth, and said shelf to be used for storing wood or other objects, said shelf being accessible through said lower openings;

doors to seal said openings;

a storage shelf provided below said hearth, and means connecting said shelf to said hearth, said shelf being solid with said hearth, said shelf being accessible through at least one of said openings so that said shelf may be used for storing wood or other objects;

lifting means connected to said hearth for moving said hearth vertically in said chimney;

vertical guide means for guiding said hearth in said chimney during vertical motion; and holding means for holding said hearth at a vertical position.

* * * * *